US006496674B2

(12) United States Patent
Pang et al.

(10) Patent No.: US 6,496,674 B2
(45) Date of Patent: Dec. 17, 2002

(54) CARRIER RECOVERY APPARATUS OF LIQUID ELECTROPHOTOGRAPHIC PRINTER

(75) Inventors: Jeong-hun Pang, Gyeonggi-do (KR); Yong-geun Kim, Gyeonggi-do (KR); Un-ho Baik, Gyeonggi-do (KR)

(73) Assignee: Samsung Electronics Co., Ltd, Kyungki-Do (KR)

( * ) Notice: Subject to any disclaimer, the term of this patent is extended or adjusted under 35 U.S.C. 154(b) by 0 days.

(21) Appl. No.: 09/880,839

(22) Filed: Jun. 15, 2001

(65) Prior Publication Data

US 2002/0090232 A1 Jul. 11, 2002

(30) Foreign Application Priority Data

Jan. 8, 2001 (KR) ..... 2001-916

(51) Int. Cl.[7] ..... G03G 15/10
(52) U.S. Cl. ..... 399/250
(58) Field of Search ..... 399/249–251

(56) References Cited

U.S. PATENT DOCUMENTS 3,880,515 A * 4/1975 Tanaka et al. ..... 399/250
5,884,128 A * 3/1999 Park ..... 399/250
6,085,055 A * 7/2000 Shin et al. ..... 399/250
6,101,356 A * 8/2000 Kim et al. ..... 399/250
6,141,518 A * 10/2000 Shin et al. ..... 399/250

* cited by examiner

*Primary Examiner*—William J. Royer
(74) *Attorney, Agent, or Firm*—Sughrue Mion, PLLC

(57) ABSTRACT

In one aspect, a carrier recovery apparatus of a liquid electrophotographic printer includes a drying unit, a cooling unit for cooling and condensing carrier vapor evaporated by the drying unit, a condenser for condensing the carrier vapor which has not been condensed by the cooling unit, and a carrier recovery container. In another aspect, a carrier recovery apparatus of a liquid electrophotographic printer includes a drying unit, a first cooling unit for cooling and condensing carrier vapor evaporated by the drying unit, a second cooling unit for cooling the carrier which has passed through the first cooling unit, a condenser for condensing the carrier vapor which has not been condensed by the first and second cooling units, and a carrier recovery container. Accordingly, the efficiency of condensing carrier vapor is improved. As a result, the recovery percentage of a carrier increases, and the duration of a filter is extended.

10 Claims, 4 Drawing Sheets

CARRIER RECOVERY APPARATUS OF LIQUID ELECTROPHOTOGRAPHIC PRINTER

BACKGROUND OF THE INVENTION

1. Field of the Invention

The present invention relates to an apparatus for recovering a carrier from a photoreceptor belt of a liquid electrophotographic printer.

2. Description of the Related Art

Generally, liquid electrophotographic printers, applied to printers or photocopiers, print an image by applying a developer, in which a solid toner of a predetermined color is mixed with a liquid carrier acting as a solvent, to an electrostatic latent image formed on a photoreceptor medium such as a photoreceptor belt running along an endless track.

FIG. 1 is a schematic diagram illustrating the configuration of a conventional liquid electrophotographic printer. Referring to FIG. 1, a liquid electrophotographic printer includes a photoreceptor belt 10 which is supported by a plurality of guide rollers 11 and runs along an endless track, a plurality of development devices 13*a*, 13*b*, 13*c* and 13*d*, a drying unit 20 and a transfer roller 16.

The photoreceptor belt 10 is charged to a predetermined potential at a charging station 15. The potential of the photoreceptor belt 10 changes depending on beams emitted from a plurality of laser scanning units 14*a*, 14*b*, 14*c* and 14*d* which are installed in close proximity to the respective development devices 13*a*, 13*b*, 13*c* and 13*d*, so that an electrostatic latent image is formed on the photoreceptor belt 10. The development devices 13*a*, 13*b*, 13*c* and 13*d* allow a developer, in which a toner is mixed with a liquid carrier, to selectively adhere to an electrostatic latent image area on the photoreceptor belt 10. Toners T are supplied to a transfer roller 16, and then transferred to printing paper P passing between the transfer roller 16 and a fixing roller 17 due to a difference in surface energy.

The drying unit 20 includes a drying roller 22 and heating rollers 24. The drying roller 22 absorbs the liquid carrier from the photoreceptor belt 10 which has passed the development devices 13*a*, 13*b*, 13*c* and 13*d*. The heating rollers 24 assist the function of the drying roller 22 by evaporating the liquid carrier absorbed by the drying roller 22. Since the evaporated carrier negatively affects the human body, it is necessary to prevent the evaporated carrier from effusing to the air. Moreover, it is necessary to recover the carrier in order to reduce the consumption of the carrier so that costs can be reduced. Accordingly, a liquid electrophotographic printer is usually provided with a carrier recovery apparatus for recovering a liquid carrier by collecting and condensing carrier vapor evaporated by the drying unit 20.

FIG. 2 is a schematic diagram illustrating a conventional carrier recovery apparatus provided near a drying unit in a liquid electrophotographic printer. Referring to FIG. 2, a drying unit 20 includes a drying roller 22, heating rollers 24 and a manifold 25. The drying roller 22 is disposed a predetermined distance from a guide roller 11 to be parallel with the guide roller 11, and absorbs a liquid carrier which adheres to a photoreceptor belt 10. The heating rollers 24 evaporate the liquid carrier absorbed by the drying roller 22. The manifold 25 collects the evaporated carrier vapor. In this case, some of the collected carrier vapor is liquefied and induced to a carrier recovery container 40 provided under the manifold 25, and the remaining carrier vapor is induced to a condenser 30.

The condenser 30 contains a low temperature liquid condensate. The upper portion of the condenser 30 is connected to an inflow pipe 31 through which the carrier vapor flows from the drying unit 20 into the condenser 30 and to a carrier vapor discharge pipe 34 through which uncondensed carrier vapor is discharged from the condenser 30. One side of the condenser 30 is connected to a carrier liquid discharge pipe 33 through which a condensed liquid carrier is discharged from the condenser 30. A peltier chip 44 is provided on another side of the condenser 30 to maintain a low temperature inside the condenser. Heat generated from the peltier chip 44 is effused to a heat sink 46.

Carrier vapor is induced from the drying unit 20 into the condenser 30 through the inflow pipe 31. Then, the carrier vapor contacts the liquid condensate to be liquefied. Uncondensed carrier vapor is induced through the carrier vapor discharge pipe 34 to a filter 35 and discharged to the outside through the filter 35. A liquid carrier condensed in the condenser 30 is discharged through the carrier liquid discharge pipe 33 to the carrier recovery container 40.

A first pump 32 for pumping carrier vapor out of the drying unit 20 into the condenser 30 is installed at a predetermined portion of the inflow pipe 31. A second pump 42 for supplying a liquid carrier collected within the carrier recovery container 40 to a development device (not shown) is installed at a predetermined portion of a carrier supply pipe 41. A third pump 52 for discharging carrier vapor is installed at a predetermined portion of the carrier vapor discharge pipe 34.

In a carrier recovery apparatus having such a structure, high temperature carrier vapor generated in the drying unit 20 may flow into the condenser 30 through the inflow pipe 31 without being cooled down appropriately, thereby decreasing the efficiency of condensing carrier vapor. Consequently, the recovery percentage of a carrier decreases. In addition, polluted carrier vapor which is not sufficiently filtered is discharged from the condenser 30, thereby shortening the duration of the filter 35.

SUMMARY OF THE INVENTION

To solve the above problems, it is an object of the present invention to provide a carrier recovery apparatus using a cooling unit with a radiator in a liquid electrophotographic printer to improve the efficiency of condensing carrier vapor, thereby increasing the recovery percentage of a carrier and extending the duration of a filter.

Accordingly, to achieve the above object of the invention, in one embodiment, there is provided a carrier recovery apparatus of a liquid electrophotographic printer, including a drying unit for absorbing and evaporating a liquid carrier remaining on a photoreceptor belt after development, a cooling unit for cooling and condensing carrier vapor evaporated by the drying unit, a condenser for cooling the carrier vapor which has passed through the cooling unit to condense the carrier vapor which has not been condensed by the cooling unit, and a carrier recovery container for storing a liquid carrier discharged from the condenser.

In another embodiment, there is provided a carrier recovery apparatus of a liquid electrophotographic printer, including a drying unit for absorbing and evaporating a liquid carrier remaining on a photoreceptor belt after development, a first cooling unit for cooling and condensing carrier vapor evaporated by the drying unit, a second cooling unit for cooling the carrier vapor which has passed through the first cooling unit to condense the carrier vapor which has not been condensed by the first cooling unit, a condenser for cooling the carrier vapor which has passed through the second cooling unit to condense the carrier vapor which has not been condensed by the first and second cooling units, and a carrier recovery container for storing a liquid carrier discharged from the condenser.

BRIEF DESCRIPTION OF THE DRAWINGS

The above object and advantages of the present invention will become more apparent by describing in detail preferred embodiments thereof with reference to the attached drawings, in which.

DETAILED DESCRIPTION OF THE PREFERRED EMBODIMENTS

Figure 1:
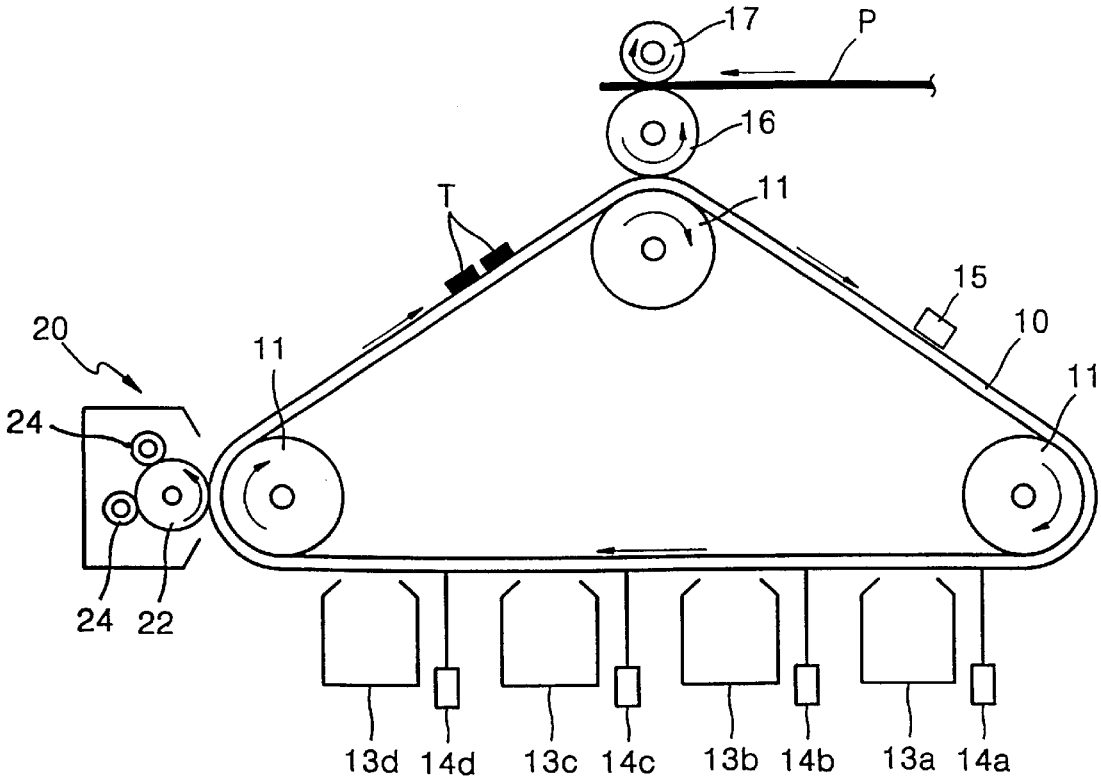
FIG. 1 (PRIOR ART)
FIG. 1 is a schematic diagram illustrating the main portions of a conventional liquid electrophotographic printer.
Figure 2:
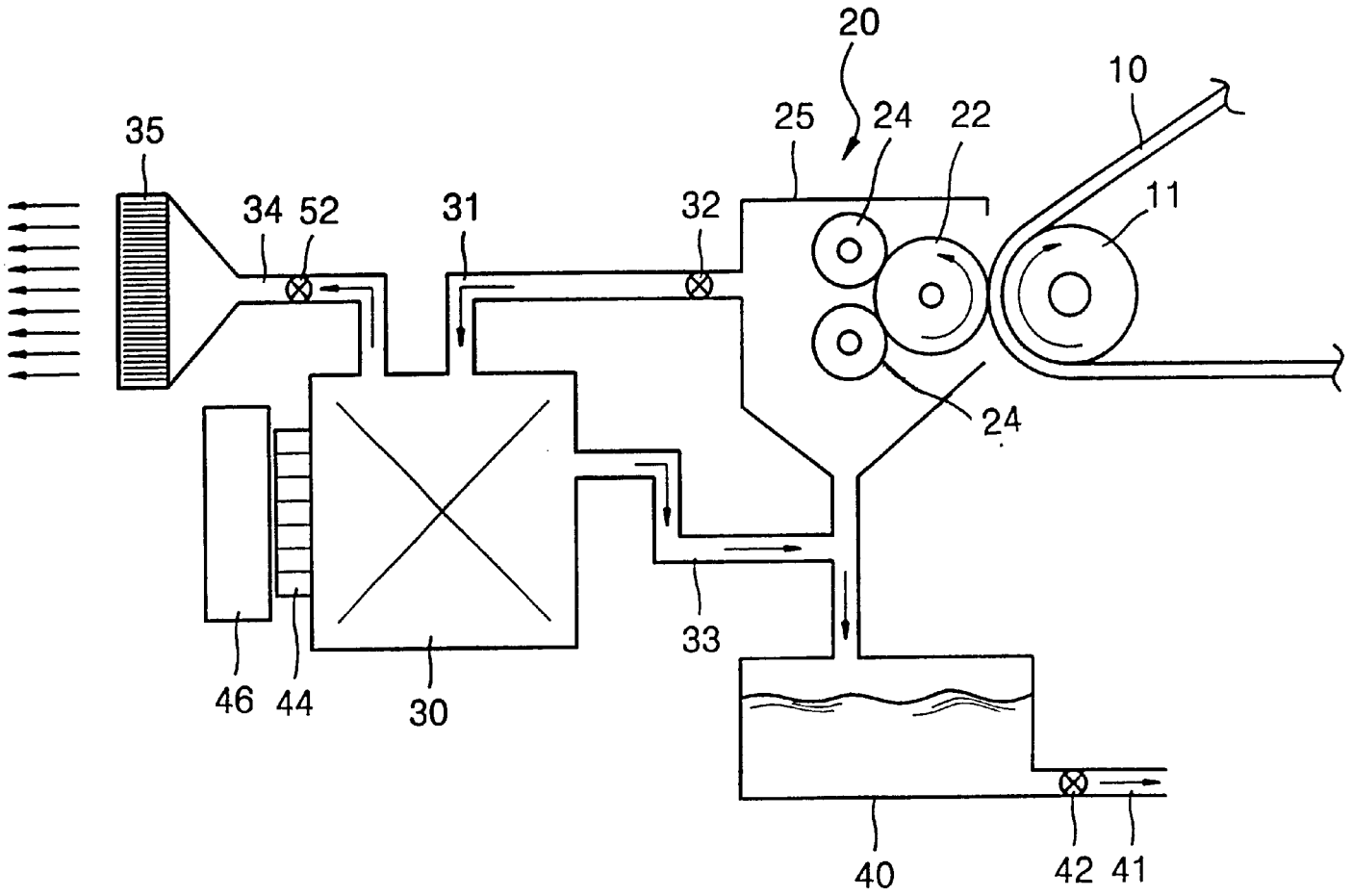
FIG. 2 (PRIOR ART)
FIG. 2 is a schematic diagram illustrating a carrier recovery apparatus of a conventional liquid electrophotographic printer.
Figure 3:
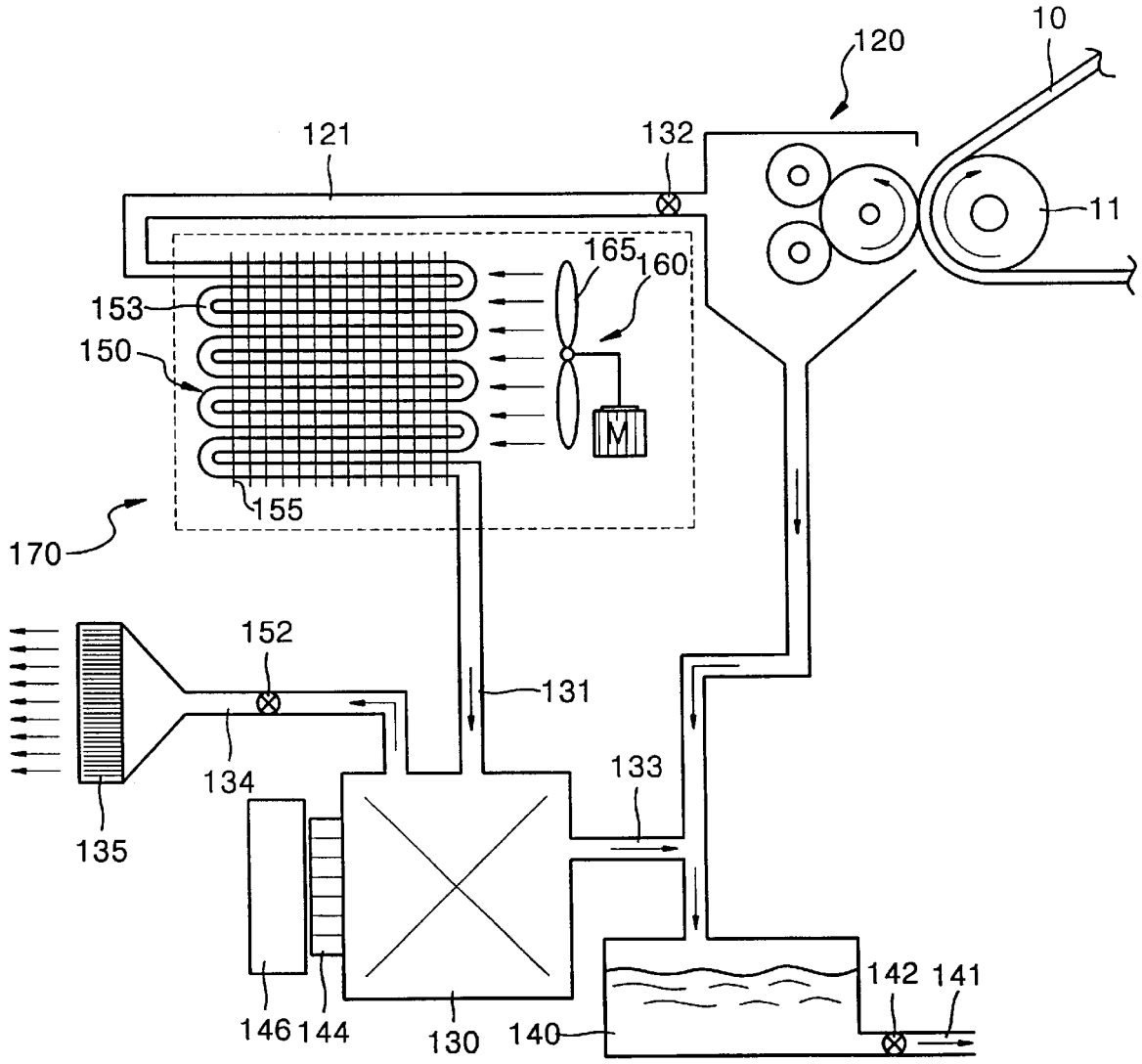
FIG. 3 is a schematic diagram illustrating a carrier recovery apparatus of a liquid electrophotographic printer according to a first embodiment of the present invention.

FIG. 3 schematically illustrates the configuration of a carrier recovery apparatus according to a first embodiment of the present invention. In FIGS. 2 and 3, the same reference numerals denote the same members having the same functions. Referring to FIG. 3, the carrier recovery apparatus includes a drying unit 120, a cooling unit 170 having a radiator 150, a condenser 130 and a carrier recovery container 140.

As described above, the drying unit 120 absorbs and evaporates a liquid carrier remaining on a photoreceptor belt 10 after development. Some of the carrier vapor evaporated by the drying unit 120 is liquefied and induced into the carrier recovery container 140 provided under the drying unit 120. The remaining carrier vapor is induced to the radiator 150 through a first inflow pipe 121. A first pump 132 is installed at the first inflow pipe 121 to make the carrier vapor flow toward the radiator 150.

The radiator 150 cools the high temperature carrier vapor generated in the drying unit 120 and condenses some of the carrier vapor. To enhance a cooling effect, the radiator 150 comprises a brass pipe 153 having a plurality of radiation fins 155, and a ventilation device 160 including a cooling fan 165 in order to blow air, and a motor M for driving the cooling fan 165 is provided near the radiator 150. When the carrier vapor evaporated by the drying unit 120 passes through the radiator 150 while the ventilation device 160 is operating, the high temperature carrier vapor (about 70° C.) is cooled to an outside temperature of the radiator 150, that is, to a temperature near room temperature. In this case, due to the change of temperature, some of the carrier vapor generated in the drying unit 120 condenses into liquid while passing through the radiator 150. The carrier passing through the radiator 150 is then induced into the condenser 130 through a second inflow pipe 131.

The condenser 130 condenses uncondensed carrier vapor among the carrier which has passed through the radiator 150. A low temperature liquid condensate (not shown) is contained in the condenser 130. The carrier vapor contacts the liquid condensate and is condensed and liquefied. The upper portion of the condenser 130 is connected to the second inflow pipe 131 through which the carrier is induced from the radiator 150 to the condenser 130 and to a carrier vapor discharge pipe 134 through which carrier vapor that is not condensed in the condenser 130 is discharged. One side of the condenser 130 is connected to a carrier liquid discharge pipe 133 through which a liquid carrier condensed in the condenser 130 is discharged. A peltier chip 144 is provided on another side of the condenser 130 to maintain the inside of the condenser 130 at a low temperature. A heat sink 146 for effusing heat generated by the peltier chip 144 is also provided. When a carrier passes through the radiator 150 and flows into the condenser 130, the carrier contacts the liquid condensate within the condenser 130 and is cooled to a desirable temperature. In this case, the carrier vapor which has not condensed in the radiator 150 is condensed and liquefied.

In such a configuration, the high temperature carrier vapor evaporated by the drying unit 120 is cooled to a temperature near room temperature so as to be primarily condensed while it passes through the radiator 150. A carrier which has passed through the radiator 150 is cooled to a desirable temperature so as to be secondarily condensed while it passes through the condenser 130 provided with the peltier chip 144 and the heat sink 146. In other words, the high temperature carrier vapor from the drying unit 120 undergoes the two condensing steps. As a result, the efficiency of condensing carrier vapor is improved beyond that of a conventional carrier recovery apparatus. After the two condensation steps, a condensed liquid carrier is stored in the carrier recovery container 140 through the carrier liquid discharge pipe 133, and uncondensed carrier vapor is induced to a filter 135 through the carrier vapor discharge pipe 134, to which a third pump 152 is installed, and discharged from the carrier recovery apparatus.

The carrier recovery container 140 stores the condensed liquid carrier collected from the radiator 150 and the condenser 130 and lets it flow to a development device (not shown). The carrier recovery container 140 is connected to a carrier supply pipe 141. A second pump 142 is installed in the carrier supply pipe 141 in order to pump the liquid carrier into the development device.

Figure 4:
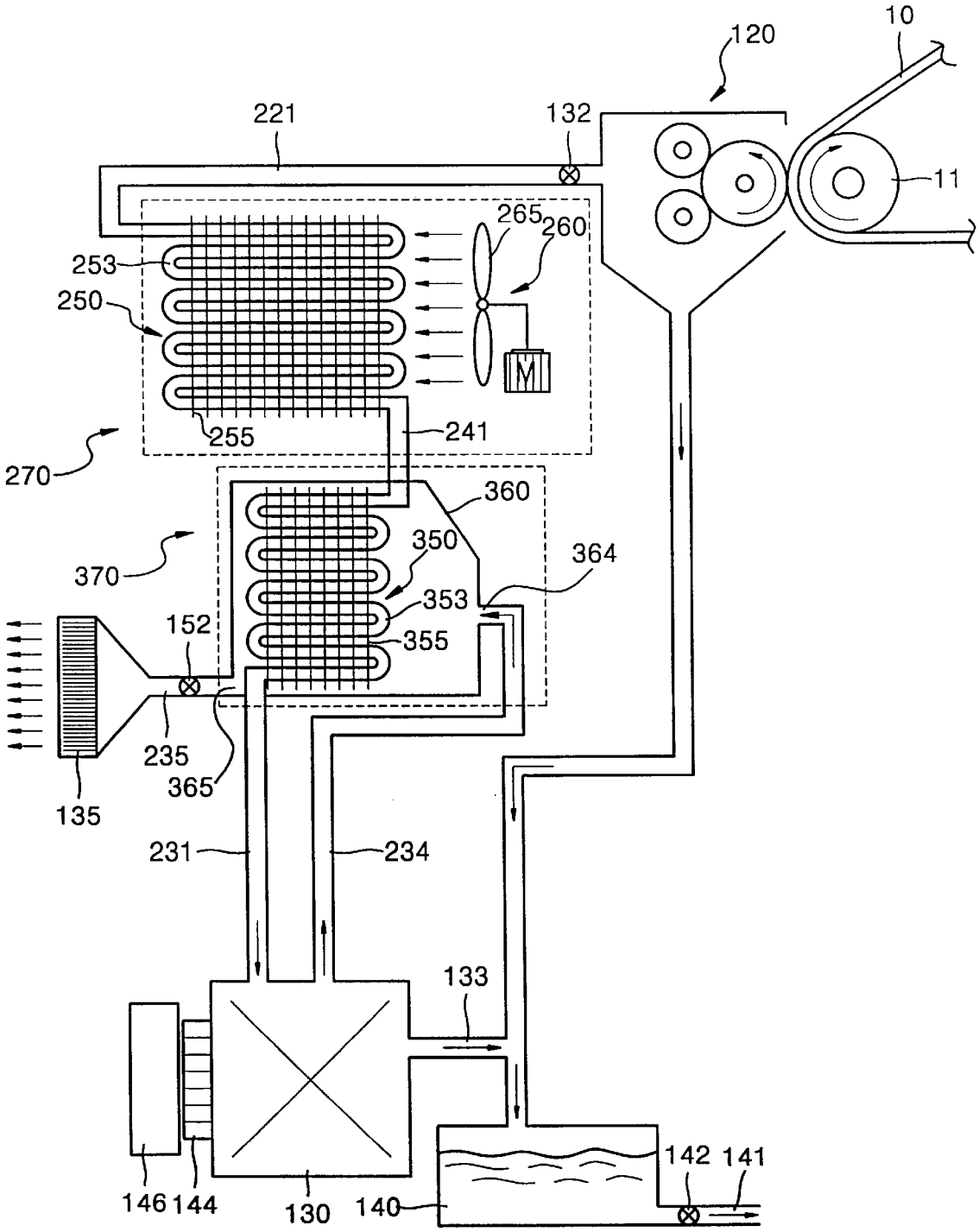
FIG. 4 is a schematic diagram illustrating a carrier recovery apparatus of a liquid electrophotographic printer according to a second embodiment of the present invention.

FIG. 4 schematically illustrates the configuration of a carrier recovery apparatus according to a second embodiment of the present invention. In FIGS. 3 and 4, the same reference numerals denote the same members having the same functions. Referring to FIG. 4, the carrier recovery apparatus includes a drying unit 120, a first cooling unit 270, a second cooling unit 370, a condenser 130 and a carrier recovery container 140.

As described above, the drying unit 120 absorbs and evaporates a liquid carrier remaining on a photoreceptor belt 10 after development. Some of the carrier vapor evaporated by the drying unit 120 is liquefied and induced into the carrier recovery container 140. The remaining carrier vapor is induced to the first cooling unit 270 through a first inflow pipe 221.

The first cooling unit 270 includes a first radiator 250 and a ventilation device 260. To enhance a cooling effect, as described before, the first radiator 250 comprises a first brass pipe 253 having a plurality of first radiation fins 255 on its outer surface. The ventilation device 260 includes a cooling fan 265 for blowing air on the first radiator 250 and a motor M for driving the cooling fan 265. The first cooling unit 270 has the same structure and function as the cooling unit described in FIG. 3. That is, the first cooling unit 270 cools carrier vapor evaporated by the drying unit 120 to a temperature near room temperature and condenses some of the carrier vapor. The carrier which has passed through the first radiator 250 is induced to the second cooling unit 370 through a second inflow pipe 241.

The second cooling unit 370 cools the carrier having a temperature near room temperature after passing through the first radiator 250, and includes a second radiator 350 and a cooling manifold 360. The second radiator 350, which has the same structure as the first radiator 250, comprises a second brass pipe 353 having a plurality of second radiation fins 355. The cooling manifold 360 is configured to surround the second radiator 350. A carrier vapor inlet 364 is formed at one side of the cooling manifold 360 so that carrier vapor which has not condensed in the condenser 130, which will be described later, can be induced into the cooling manifold 360 through a first carrier vapor discharge pipe 234. A carrier vapor outlet 365 is formed on the opposite side of the cooling manifold 360 so that the induced carrier vapor can be effused.

The carrier vapor effused through the carrier vapor outlet 365 is discharged through a second carrier vapor discharge pipe 235 and a filter 135. The second cooling unit 370 cools the carrier which has passed through the first radiator 250 from near room temperature to a lower temperature using the carrier vapor that has not condensed in the condenser 130. This will be described later. The carrier which has passed through the second radiator 350 is induced to the condenser 130 through a third inflow pipe 231.

The condenser 130 condenses uncondensed carrier vapor among the carrier which has passed through the second radiator 350. A low temperature liquid condensate is contained in the condenser 130. The upper portion of the condenser 130 is connected to the third inflow pipe 231 through which the carrier passed through the second radiator 350 is induced to the condenser 130 and to the first carrier vapor discharge pipe 234 through which carrier vapor that is not condensed in the condenser 130 is discharged. One side of the condenser 130 is connected to a carrier liquid discharge pipe 133 through which a liquid carrier condensed in the condenser 130 is discharged. As described before, a peltier chip 144 and a heat sink 146 are provided on another side of the condenser 130. When a carrier passed through the second radiator 350 flows into the condenser 130, the carrier contacts the liquid condensate within the condenser 130 and is cooled to a desirable temperature. In this case, carrier vapor which has not been condensed by the second cooling unit 370 is finally condensed and liquefied.

The liquid carrier cooled and condensed in the condenser 130 is induced to the carrier recovery container 140 through the carrier liquid discharge pipe 133 and stored in the carrier recovery container 140. Carrier vapor which has not condensed in the condenser 130 is induced to the cooling manifold 360 through the first carrier vapor discharge pipe 234, cooled by the second radiator 350, and then discharged through the second carrier vapor discharge pipe 235 and the filter 135. In this case, the temperature of the carrier vapor induced to the cooling manifold 360 is lower than room temperature so that a carrier having room temperature after passing through the first radiator 250 is cooled to a lower temperature while passing through the second radiator 350. As a result, some of the carrier vapor which has not condensed after passing through the first radiator 250 is condensed and liquefied in the second radiator 350. The carrier which has passed through the second radiator 350 is induced to the condenser 130 through the third inflow pipe 231 and finally cooled and condensed in the condenser 130.

Consequently, a carrier having a temperature near room temperature after passing through the first radiator 250 is cooled to a lower temperature so as to be condensed using carrier vapor which has not condensed in the condenser 130, and then induced to the condenser 130 so that the efficiency of condensing the carrier vapor can be improved without consuming additional power.

The liquid carrier which is condensed by the first radiator 250, the second radiator 350 and the condenser 130 is collected and stored in the carrier recovery container 140 and supplied to the development device through the carrier supply pipe 141.

As described above, by cooling carrier vapor evaporated by a drying unit near room temperature using a cooling unit having a radiator before inducing it to a condenser, the efficiency of condensing the carrier vapor can be increased, and power consumed by the condenser can be decreased. Meanwhile, by re-cooling the carrier of the room temperature to a lower temperature using carrier vapor which has not condensed in the condenser, the efficiency of condensing the carrier vapor can be further improved without additional power consumption.

Accordingly, the amount of carrier recovered increases. In addition, since carrier vapor sufficiently filtered in the condenser is discharged after passing through a filter, the duration or useful life of the filter increases. As a result, the cost of maintenance of a carrier recovery apparatus can be reduced.

It is contemplated that numerous modifications may be made to the carrier recovery apparatus of liquid electrophotographic printer of the present invention without departing from the spirit and scope of the invention as defined in the following claims.

What is claimed is:

1. A carrier recovery apparatus of a liquid electrophotographic printer, comprising:

a drying unit which absorbs and evaporates a liquid carrier remaining on a photoreceptor belt after development;

a cooling unit which cools and condenses a carrier vapor evaporated by the drying unit;

a condenser which cools the carrier vapor that has passed through the cooling unit to condense the carrier vapor which has not been condensed by the cooling unit; and a carrier recovery container which stores a liquid carrier discharged from the condenser;

wherein the cooling unit comprises a radiator and a ventilation device which is provided outside the radiator to blow air on the radiator, and cools the carrier vapor evaporated by the drying unit to a temperature near room temperature so as to condense the carrier vapor.

2. The carrier recovery apparatus of claim 1, wherein the radiator comprises a brass pipe through which the carrier vapor evaporated by the drying unit passes and a plurality of radiation fins formed on an outer surface of the brass pipe.

3. The carrier recovery apparatus of claim 2, further comprising a peltier chip provided on one side of the condenser for maintaining a low temperature inside the condenser.

4. The carrier recovery apparatus of claim 1, further comprising a peltier chip provided on one side of the condenser for maintaining a low temperature inside the condenser.

5. A carrier recovery apparatus of a liquid electrophotographic printer, comprising:

a drying unit which absorbs and evaporates a liquid carrier remaining on a photoreceptor belt after development;

a first cooling unit which cools and condenses a carrier vapor evaporated by the drying unit;

a second cooling unit which cools the carrier vapor that has passed through the first cooling unit to condense the carrier vapor which has not been condensed by the first cooling unit;

a condenser which cools the carrier vapor that has passed through the second cooling unit to condense the carrier vapor which has not been condensed by the first and second cooling units; and a carrier recovery container which stores a liquid carrier discharged from the condenser.

6. The carrier recovery apparatus of claim 5, wherein the first cooling unit comprises a first radiator and a ventilation device which is provided outside the first radiator to blow air on the first radiator, and cools the carrier vapor evaporated by the drying unit to a temperature near room temperature so as to condense the carrier vapor.

7. The carrier recovery apparatus of claim 6, wherein the first radiator comprises a first brass pipe through which the carrier vapor evaporated by the drying unit passes and a plurality of first radiation fins formed on an outer surface of the first brass pipe.

8. The carrier recovery apparatus of claim 6, wherein the second cooling unit comprises a second radiator and a cooling manifold which is configured to surround the second radiator, on one side of which is a carrier vapor inlet for allowing the carrier vapor which has not condensed in the condenser to be induced to the cooling manifold, and on an opposite side of which is a carrier vapor outlet for allowing the carrier vapor to be discharged, and cools the carrier vapor which has passed through the second radiator using the carrier vapor induced to the cooling manifold through the carrier vapor inlet.

9. The carrier recovery apparatus of claim 8, wherein the second radiator comprises a second brass pipe through which the carrier vapor cooled by the first radiator passes and a plurality of second radiation fins formed on an outer surface of the second brass pipe.

10. The carrier recovery apparatus of claim 8, further comprising a peltier chip provided on one side of the condenser for maintaining a low temperature inside the condenser.

* * * * *